United States Patent [19]

Uyeda

[11] Patent Number: 4,665,727

[45] Date of Patent: May 19, 1987

[54] MANUALLY OPERATED LOCK MECHANISM FOR BYPASS OF CUSTOMER OPERATED ELECTRONIC DIGITAL SAFE LOCK

[75] Inventor: Tim Uyeda, Rosemead, Calif.

[73] Assignees: Alan K. Uyeda, Rosemead; Peter J. Phillips, Redondo Beach; Klaus W. Gartner, Palos Verdes Estates, all of Calif.

[21] Appl. No.: 815,357

[22] Filed: Dec. 30, 1985

[51] Int. Cl.[4] ..... E05B 47/00

[52] U.S. Cl. ..... 70/279; 70/277; 70/311; 70/333 A; 70/333 R

[58] Field of Search ..... 70/279, 278, 302, 303 A, 70/303 R, 311, 333 A, 333 R, 149, 280

[56] References Cited

U.S. PATENT DOCUMENTS

| | | | |
|---|---|---|---|
| 450,068 | 4/1891 | Grefen | 70/279 |
| 473,061 | 4/1892 | Crockett & Allen | 70/279 |
| 504,462 | 9/1893 | Tinkham | 70/149 |
| 613,585 | 11/1898 | Miner | 70/333 R |
| 767,757 | 8/1904 | Jacobsen & Blasser | 70/279 |
| 792,404 | 6/1905 | Dean | 70/278 |
| 1,737,414 | 11/1929 | Forman | 70/279 |
| 2,020,879 | 11/1935 | Eldred | 70/333 A |
| 2,322,724 | 6/1943 | Archer | 70/302 |
| 2,528,746 | 11/1950 | Giffen | 70/333 R |
| 2,926,516 | 3/1960 | Morawitz | 70/220 |
| 2,947,160 | 8/1960 | Wolters | 70/333 R |
| 3,529,454 | 9/1970 | Fish | 70/278 |
| 3,702,070 | 11/1972 | Gartner et al. . | |
| 3,758,734 | 9/1973 | Gartner et al. . | |
| 3,968,667 | 7/1976 | Gartner et al. . | |
| 4,038,846 | 8/1977 | Klann . | |
| 4,104,896 | 8/1978 | Hahn | 70/333 A |
| 4,125,008 | 11/1978 | Genest et al. | 70/279 |
| 4,142,388 | 3/1979 | Phillips et al. . | |
| 4,404,823 | 9/1983 | Miller et al. | 70/333 A |
| 4,468,943 | 9/1984 | Beattie et al. | 70/302 |

FOREIGN PATENT DOCUMENTS

| | | | |
|---|---|---|---|
| 2000217 | 1/1979 | United Kingdom | 70/278 |

OTHER PUBLICATIONS

"Lock Systems" Product Brochure of La Gard, Inc.

*Primary Examiner*—Thomas J. Holko
*Assistant Examiner*—Suzanne L. Dino
*Attorney, Agent, or Firm*—Poms, Smith, Lande & Rose

[57] ABSTRACT

In an electronic digital safe lock including a slide plate pivotally connected by an articulated linkage to a bolt operating lever for retracting safe door locking bolts after digital input of the electronic lock combination, a lock override is provided which includes a dial operated mechanical combination lock having a linkage pivotally interconnecting the manual combination lock bolt with the electronic lock articulated linkage of the slide plate and bolt operating lever. When the electronic lock is locked, i.e., the slide plate is immovable, the manual combination lock can be manipulated to operate the aritculated linkage to operate the bolt operating lever independent of movement of the slide plate.

7 Claims, 12 Drawing Figures

IV
IV

MANUALLY OPERATED LOCK MECHANISM FOR BYPASS OF CUSTOMER OPERATED ELECTRONIC DIGITAL SAFE LOCK

FIELD OF THE INVENTION

The invention relates to electronically operated safes which include facilities permitting the safe user to program an individually selected combination.

BACKGROUND OF THE INVENTION

Electronic safe locks are popular for use by establishments such as hotels, in individual rooms, for guests to secure and have ready access to their valuables. In general, a registered hotel guest is given a "key" or access card which can be inserted into the safe door to activate the electronic combination lock. Such safe locks are advantageous because they permit users to select their own unlocking number or combination known only to the person selecting and inputting the number. One problem with such user determined combinations is that the user can forget the selected combination and be unable to open the safe. To solve this problem, some such locks provide a key operated mechanism which can override the electronic lock. As can be appreciated, this solution significantly diminishes if not completely eliminates the security advantage of having a combination lock. Generally, a wall will ahve to be broken and/or the safe lock damaged in order to obtain access to the locked valuables.

It would therefore be desirable to have an alternate or bypass mechanism by which the safe can be unlocked without damage to the lock or its surroundings. The bypass mechanism, however, must not destroy the security of the safe itself and therefore should also be a secure locking system. It is also desirable that the bypass locking system be hidden such that only authorized persons, for example, hotel security employees, are able to activate the bypass lock using a secured combination. The mechanical bypass lock of the present invention provides the needed secondary unlocking mechanism while maintaining the necessary security of the safe.

SUMMARY OF THE INVENTION

The invention incorporates a mechanical combination lock dial drive bolt release system into an electronic, for example, solenoid driven, combination lock system using a single mechanical bolt release mechanism, i.e. a bolt operating lever, for both systems. The mechanical bypass does not interfere with normal operation of the electronic mechanism. However, when activated, it overrides the electronic system while using the solenoid locked parts to provide a fulcrum for activating the common bolt release mechanism.

The invention includes an electronic safe lock having an articulated linkage, for example, a linkage pivotally connecting a slide plate to a bolt operating lever, for moving safe bolts between door locking and door unlocking positions. The slide plate, pivotally connected to the bolt operating lever by the linkage, can be moved by manipulation of a dial after correct digital input of the electronic lock combination. A combination lock manually operable by manipulation of the dial is provided which includes a bolt movable after input of the correct manual lock combination. The combination lock bolt is pivotally connected to the linkage such that movement of the lock bolt moves the linkage independent of movement of the slide plate.

In a preferred embodiment, the linkage is a control lever having one end pivotally connected to one end of the common bolt operating lever, a second end pivotally connected to the electronic lock slide plate, and having an intermediate pivotal connection to the combination lock bolt. With this arrangement, when the electronic lock is operable, the linkage is free to pivot at the slide plate connection and the bolt operating lever connection, while the combination lock bolt is stationary, and acts as a stationary pivot point for operation of the bolt operating lever for unlocking the safe. On the other hand, when the electronic lock slide plate is stationary, i.e., when the electronic lock combination has not been entered, the slide plate-linkage connection operates as a stationary pivot for the combination lock bolt and bolt operating lever to pivot for unlocking the safe.

DETAILED DESCRIPTION OF A PREFERRED EMBODIMENT

The Electronic Lock Mechanism

The present invention can be used with any electronic digital lock mechanism and includes the provision of an articulated linkage between a manually movable slide plate and associated bolt works which is normally operated after input of the electronic combination effectively unlocks the slide plate. The present invention specifically provides a mechanical override of the electronic lock which utilizes an articulated linkage to operate the bolt works in an alternative manner when the slide plate is in its locked or immovable position.

Figure 1:
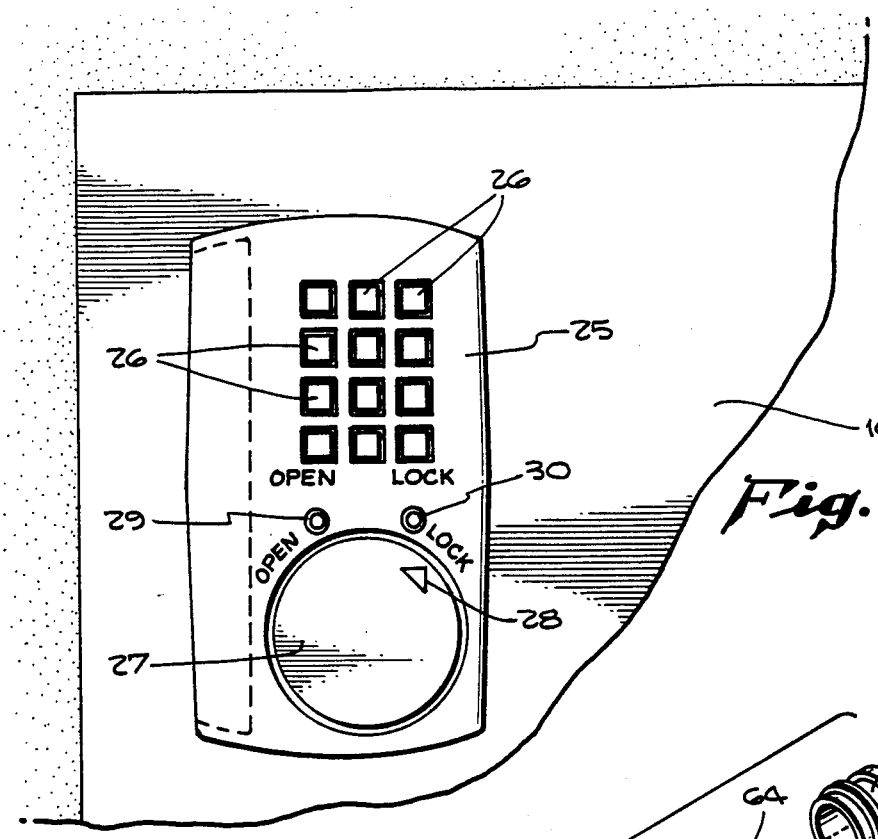
FIG. 1 shows a front view of a prior art electronic safe lock.
Figure 2:
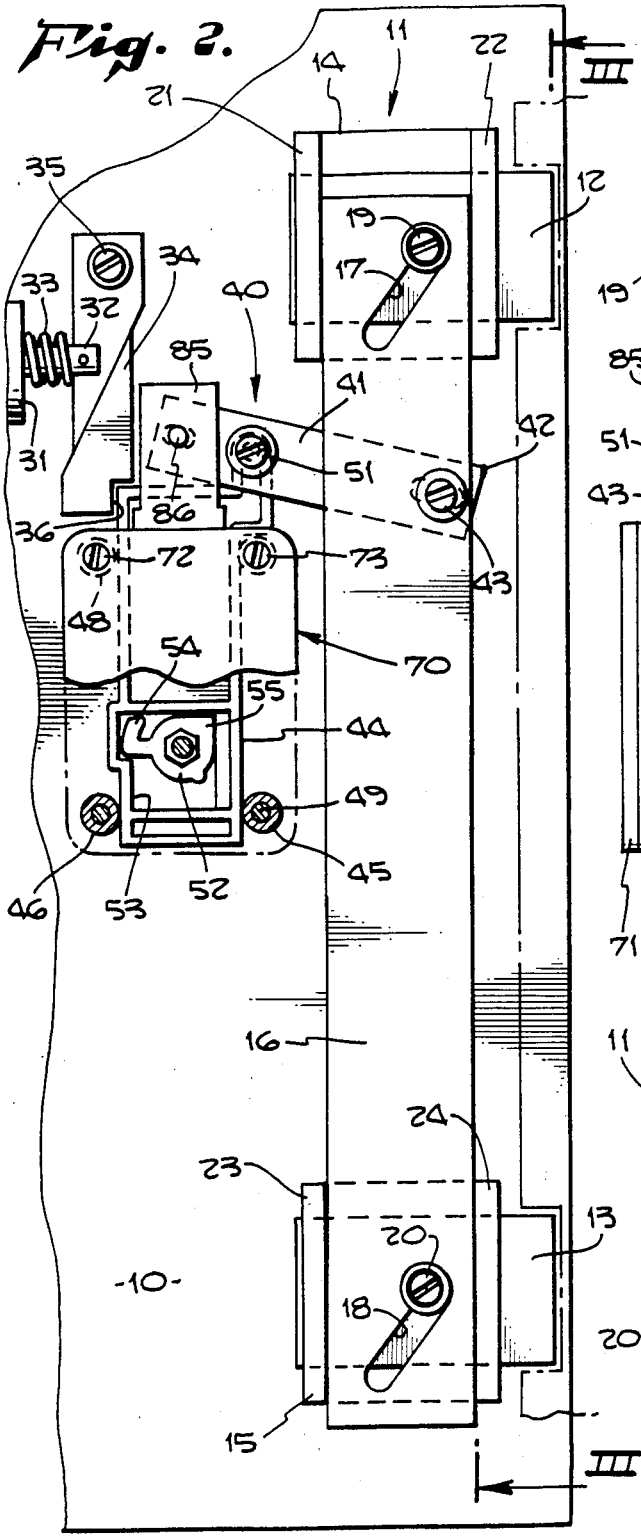
FIG. 2 is a plan view, partially in section, of the locking mechanism of the present invention in its closed or locked position.
Figure 3:
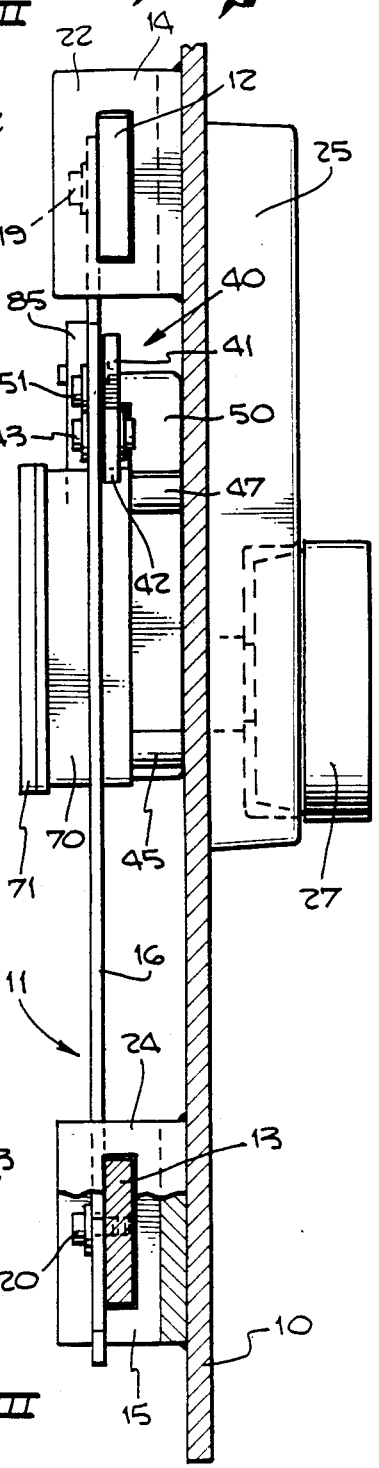
FIG. 3 is a sectional view taken along line III—III of FIG. 2.

With reference to FIGS. 1, 2 and 3, there is shown a safe door 10 having bolt works 11 for securing the door against the safe. The bolt works 11 includes bolts 12 and 13 mounted by "U" brackets 14 and 15 welded to the door 10. A bolt operating plate 16 has cam slots 17 and 18 therein for receiving pins 19 and 20 respectively. The pins 19 and 20 extend from the locking bolts 12 and 13 to act as cam followers for the slots 17 and 18 to move the locking bolts sideways as shown in FIG. 2 in response to up and down movement of the bolt operating plate 16. The "U" brackets 14 and 15 include sidewalls 21, 22, 23 and 24 which act as guide members for the locking bolts 12 and 13.

A typical digital electronic lock panel is illustrated in FIG. 1 and includes a front housing 25 having numbered buttons 26 for inputting a selected combination and thereafter for inputting the combination to unlock the safe. The housing 25 also includes a knob 27 for mechanically moving the bolt works after the correct unlocking combination has been entered. The knob 27 includes a reference line 28 so that the user can reference the knob position between the "open" position 29 and the "locked" position 30.

Figures 4, 5:
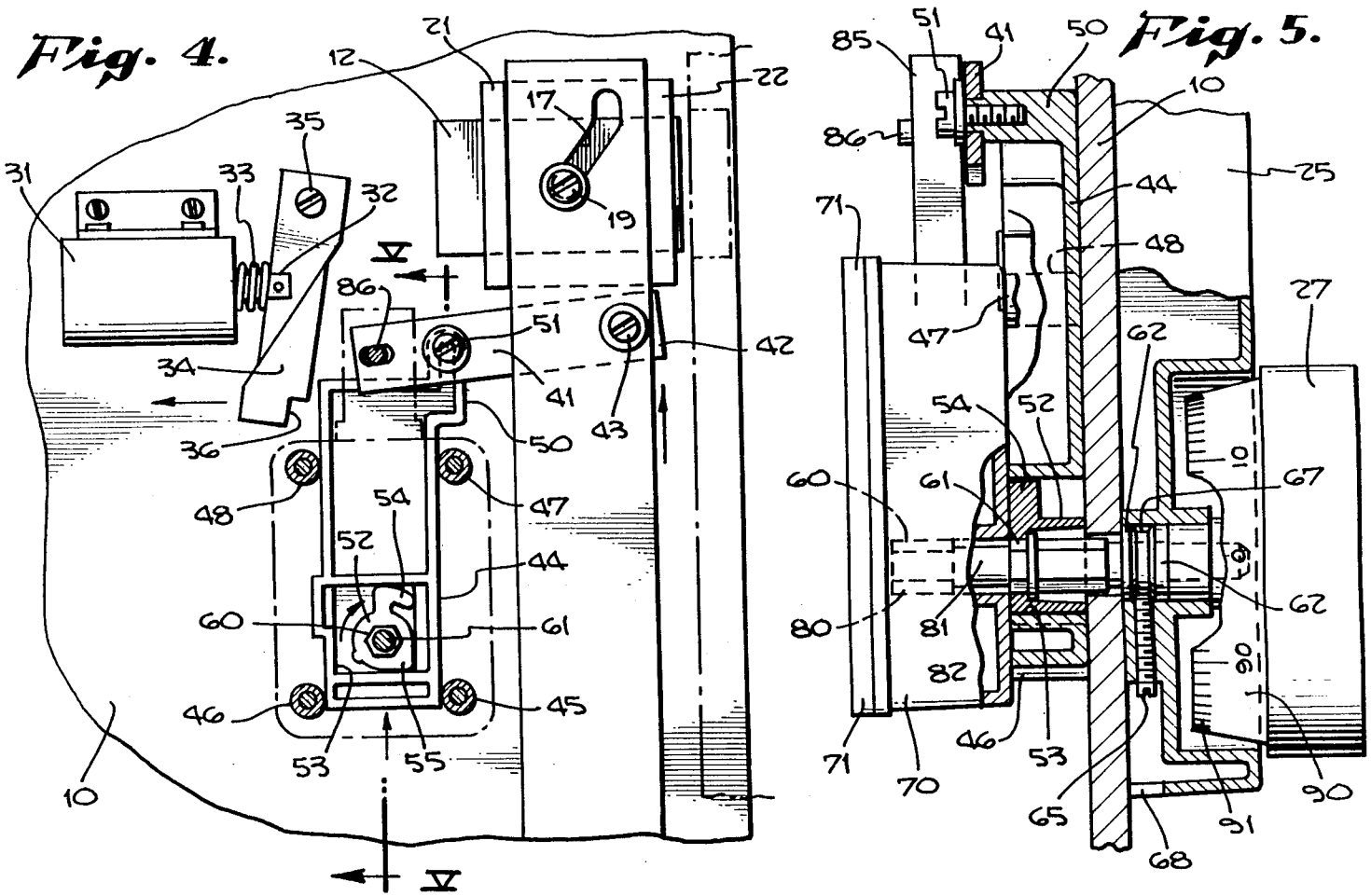
FIG. 4 is a plan view similar to FIG. 2 showing the lock in its electronically open position.
FIG. 5 is a sectional view taken along line V—V of FIG. 4 showing in detail the combination lock in its hidden, standby position.
Figure 10:
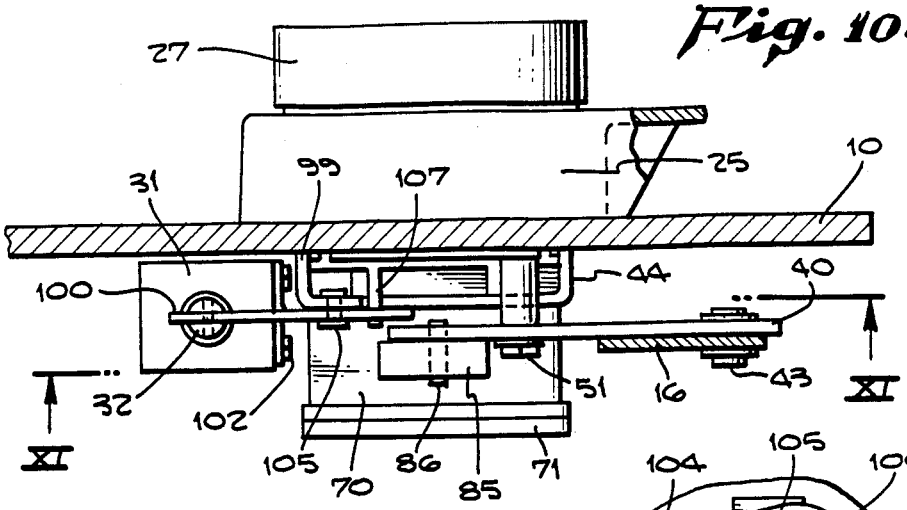
FIG. 10 is a top plan view of an alternative embodiment having modifications of the solenoid locking arm mechanism.
Figure 12:
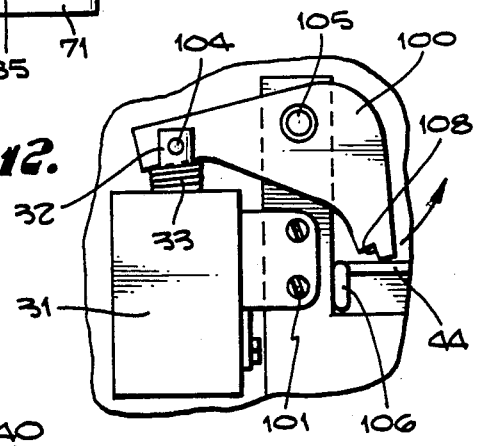
FIG. 12 is an enlarged view showing the solenoid and locking arm modification of FIG. 11.
Figure 11:
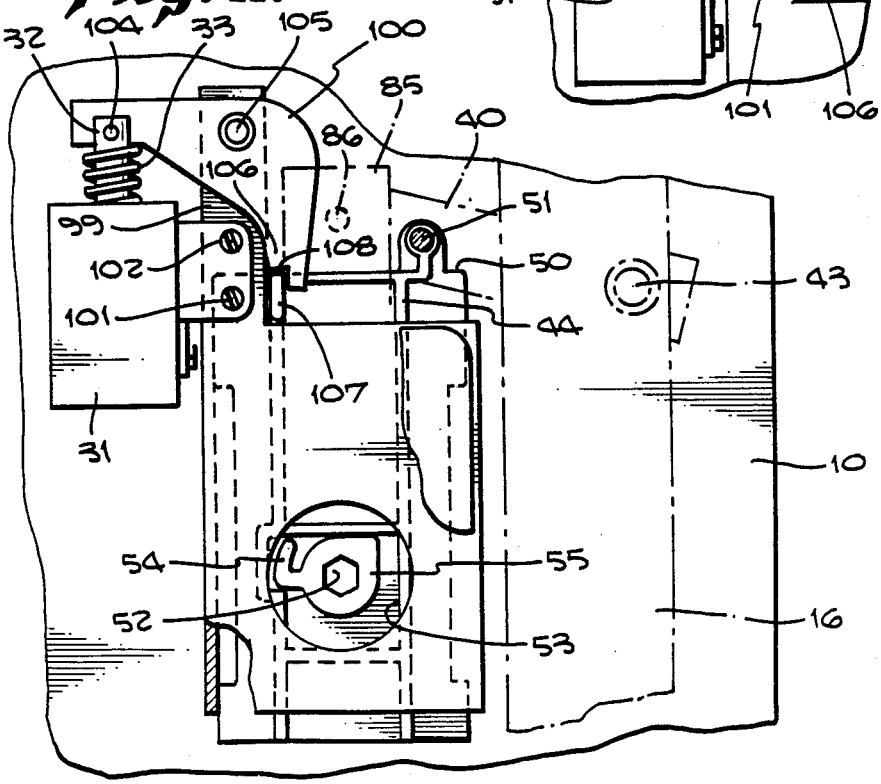
FIG. 11 is a sectional view of the modified embodiment taken along line XI—XI of FIG. 10.

The exemplary electronic digital lock mechanism includes solenoid 31 activated by user input of the correct electronic combination by way of the panel buttons 26. With reference to FIGS. 2 and 4, the solenoid 31 operates movable rod 32 which compresses spring 33 and moves lock plate 34 about pivot pin 35 from a first locked position shown in FIG. 2 to a second unlocked position shown in FIG. 4. The illustrated lock plate 34 of FIG. 4 includes a notched recess 36 to provide positive locking action with the means for maintaining the safe door locking bolts in their extended locked position. An alternative solenoid and lock plate arrangement is shown in FIGS. 10, 11 and 12, discussed below.

Articulated linkage 40 provides the operable connection between the bolt works 11 and the knob 27. The linkage 40 includes link member 41 having a first end 42 pivotally connected by pin 43 to the bolt operating plate 16. The link member 41 is connected to slide plate 44 at a mid portion thereof. Spacers 45, 46, 47 and 48 mounted about rods 49 space combination lock 70 from the door 10 inwardly of the slide plate 44. The slide plate head 50 as seen in FIG. 5 functions as the mounting boss for pin 51 pivotally connecting the link member 41 to the slide plate 44.

Drive cam 52 for moving the slide plate 44 is housed in box section portion 53 of the slide plate and includes a frangible drive part or arm 54. The arm 54 is frangible so that in the event that a user attempts to forcibly turn knob 27 when the solenoid 31 has not been activated, for example, when no combination or an incorrect combination has been electronically entered, the frangible arm 54 will break and the cam 52 will move freely without either opening the bolt works 11 or damaging remaining parts of the lock. The bolt drive cam 52 also includes a shaped peripheral edge or stop 55 which limits cam rotation to prevent breakage of the frangible arm when the slide plate 44 is freed for movement by input of the correct electronic lock combination.

Figure 8:
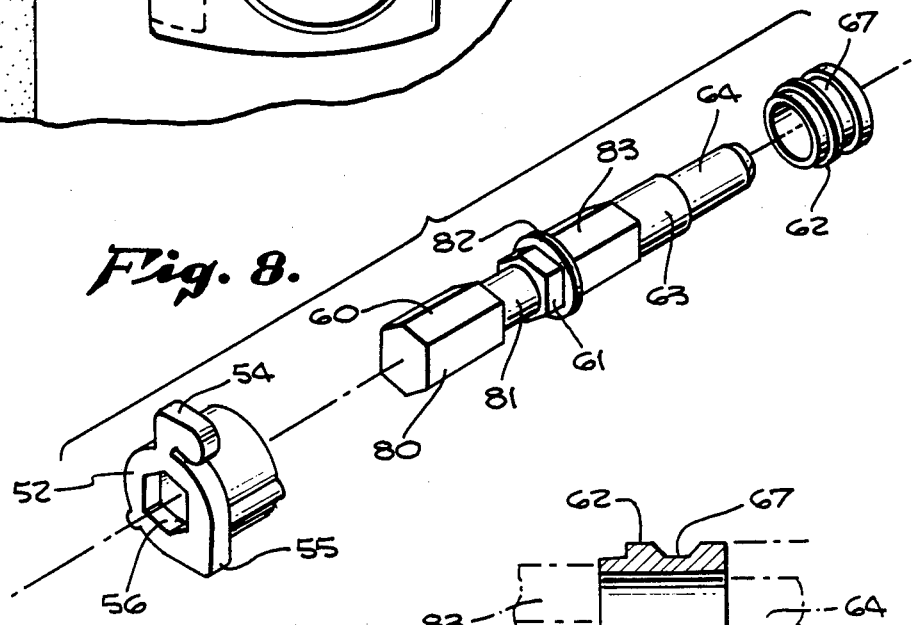
FIG. 8 is an exploded prospective view of the linkage between the combination lock dial, tumblers and electronic lock cam member.
Figure 9:
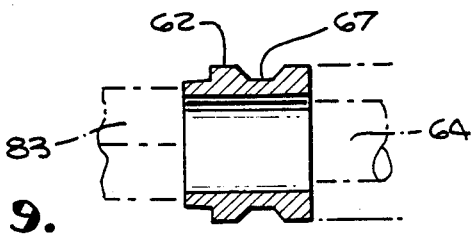
FIG. 9 is a side view of the slide bearing portion of the linkage of FIG. 8.

With reference to FIGS. 5 and 8, the bolt drive cam 52 is mounted about shaft 60, and in operation is rotated by drive part 61. The knob 27 is press fit on portion 64 of the shaft 60 with shaft 60 normally held in place by the slide bearing 62 which is press fit on shaft portion 63 and is held by set screw 65 received in recess 67 of the slide bearing 62.

Manual Override Combination Lock Mechanism

Figure 7:
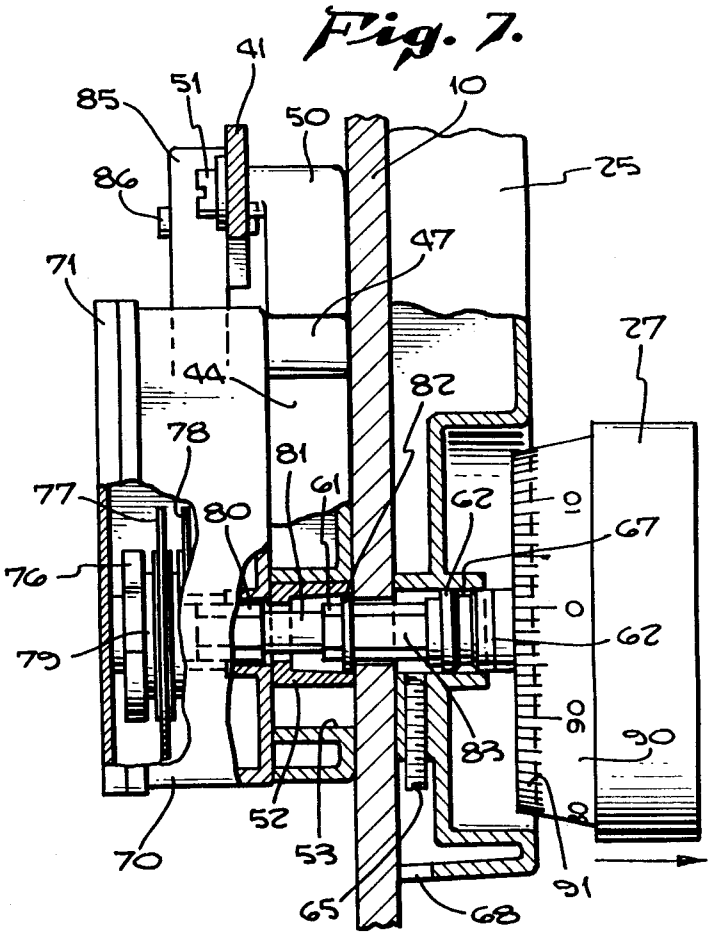
FIG. 7 is a sectional view taken along line VII—VII of FIG. 6, showing the combination lock dial in its extended position and the mechanical override in its open or unlocked position.
Figure 6:
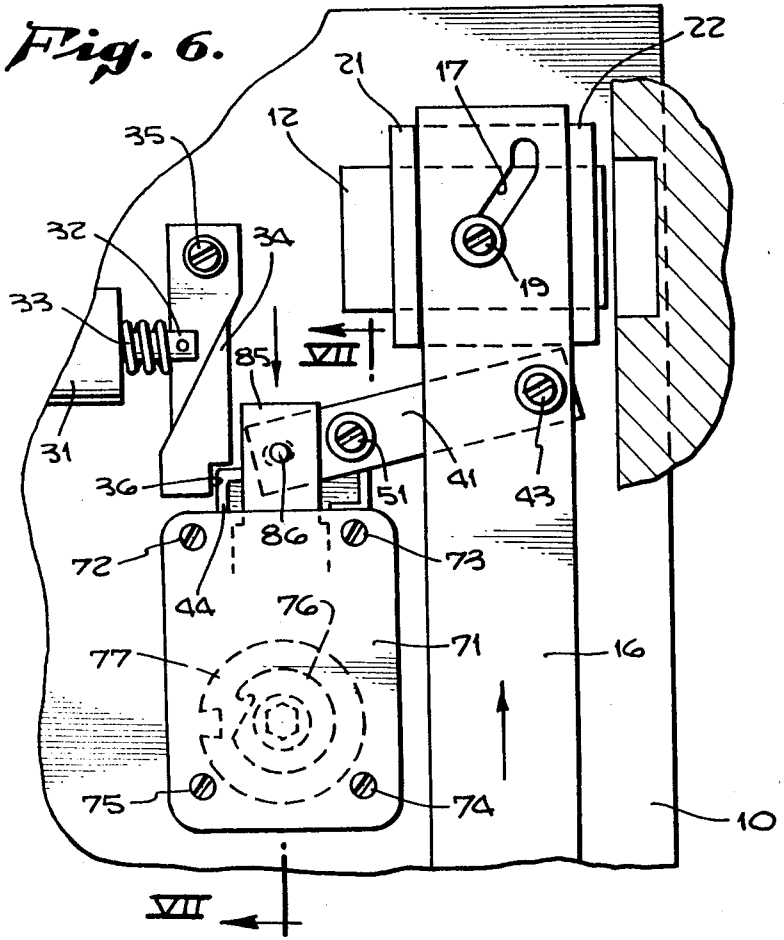
FIG. 6 is a plan view similar to FIG. 2 showing the mechanical override unlocking mechanism in its unlocked position.

As best illustrated in FIG. 7, combination lock 70 includes a cover 71 mounted by screws 72, 73, 74, and 75 (see FIG. 6). A cam wheel 76 operates tumbler wheels 77 and 78 mounted on a shaft 79 as more fully described in U.S. Pat. No. 4,142,388, the disclosure of which is incorporated here by reference. As best shown in FIG. 7, the lock shaft 79 is driven by drive part 80 mounted on the spindle 60 as shown in FIG. 8. Also mounted on the spindle 60 is a reduced diameter extension 81 to facilitate release of cam 52, a washer 82 which acts as a stop member on axial movement of the spindle, and a spacer section 83.

As shown by the exemplary embodiment of the invention illustrated in the Drawings and as best illustrated by the electronically locked, mechanically opened illustration of the locking mechanism in FIG. 6, the combination lock override of the present invention provides a means for operably connecting the manually operated tumbler wheel combination lock mechanism to the articulated linkage 40 such that when the electronic lock slide plate 44 is fixed in its locked position, the linkage can be operated independent of movement of the slide plate 44 to activate the bolt works 11. More particularly, the connection means between the manual combination lock and the bolt works 11 in the exemplary embodiment includes a lock bolt 85 pivotally connected by pin 86 at an opposite end of the link member 41 relative to the pad connected to pin 43. When the slide plate 44 is in its fixed position of FIG. 6, held in place by the abuttment of the lock pate 34 against the slide plate 44, the link member 41 is able to pivot about the pivotal connection 51 upon operation of the combination lock bolt 85. The pivotal connection 51 thus acts as a fulcrum for the link member 41 to move the bolt operating plate 16 upwardly from the position of FIG. 5 to that shown in FIG. 6, as the bolt 85 is moved inward by operation of the dial 27 after unlocking of the combination lock by turning the tumbler wheels 77 and 78 through a predetermined sequence.

When the electronic combination lock cannot be operated for opening the safe, for example, when a user forgets the combination, the mechanical override can be activated in the following manner. The set screw 65 is accessed through the aperture 68 and loosened to permit manual combination lock dial 90 having indicia 91 thereon to be moved out from its hidden recess 92 behind the electronic lock housing 25. Once exposed, input of the tumbler lock combination using the dial 90 aligns the tumbler gates and unlocks the combination lock for movement of the bolt operating plate 16 via the bolt 85 and linkage 40.

FIGS. 10, 11 and 12 illustrate an alternative embodiment of the mechanical override system of the present invention. In this embodiment, the solenoid 31 is securely mounted to a mounting bar 99 for example, by screws 101 and 102 such that the solenoid rod 32 moves in a direction parallel to the axis of the slide path 44. An arm 99 pivotally mounted to the solenoid rod 32 at 104 and pivotally mounted to the solenoid mounting bar 99 at 105. A locking member 106 is secured to the slide plate 44 for engaging recess 108 in the arm 100 and securing the slide plate 44 when the electronic lock is secured in its locked position as shown in FIG. 11. This alternative arrangement may provide more positive alignment and hence a more secure abutting relationship between the arm 100 and the locking member 106 while taking up slightly less space than the embodiment shown in FIGS. 2–9.

As can now be appreciated, the present invention maintains the security inherent in a combination lock system by providing a hidden manual combination lock override unlocking mechanism with an electronic combination lock system. The invention utilizes the mechanical bolt works of the electronic system to open the safe while the electronic lock mechanism is in its locked position. The invention provides additional security by maintaining the mechanical combination lock dial in a secreted, hidden position until activated by security personnel, and further requires the person accessing the dial to know the mechanical lock's combination before the lock can be opened. In a preferred embodiment, the mechanical lock utilizes the tumbler mechanism set forth in U.S. Pat. No. 4,142,388 to Phillips, et al. entitled "Tumbler Wheels for Combination Locks".

It is understood that various modifications and changes may be made to the exemplary embodiments described above without departing from the spirit of the invention, the scope of which is defined by the following claims.

What is claimed is:

1. A security door locking system comprising:
- a manually operable lock dial;
- an electronic digital safe lock including a slide plate and means for operating said slide plate by manipulation of the lock dial after digital input of the electronic lock combination;
- one or more safe door locking bolts operable between door locking and door unlocking positions by operation of a bolt operating lever;
- linkage means pivotally connected between said slide plate and said bolt operating lever for operating said door locking bolts between said positions upon manipulation of said dial;
- a manually operable combination lock including a movable bolt member; and
- means for pivotally connecting said movable bolt member to said linkage to operate said door locking bolts between said positions by said combination lock dial independent of movement of said slide plate.

2. The security door locking system of claim 1 wherein said linkage means comprises:
- a control lever having means for pivotally connecting a first end thereof to said bolt operating lever;
- a second pivotal connection between said control lever and said slide plate; and
- a third pivotal connection between said control lever and said slide bolt; whereby
- on operation of said electronic lock and lock dial, said third pivotal connection functions as a stationary pivot for pivotal movement of said control lever imparted by movement of said slide plate and on operation of said combination lock, said second pivotal connection functions as a stationary pivot for pivotal movement of said control lever imparted by movement of said slide bolt.

3. The security door locking system of claim 1 wherein said lock dial is connected to said slide plate by a shaft mounting said lock dial and means are provided for mounting said shaft for axial sliding movement relative to the electronic and combination locks, said lock dial includes a manually engageable pin and an inwardly extending lock dial indicia-bearing skirt, releasable holding means are provided for holding said shaft in normal operating position, and stop means are provided on said shaft for limiting outward travel of said shaft and said lock dial.

4. A security door locking system having one or more door locking bolts and comprising:
- articulated linkage means for moving said one or more bolts between door locking and door unlocking positions in either of two manipulative modes;
- manually operated means for operating said linkage in both modes;
- electronic lock means for allowing operation of said linkage in a first one of said modes when a predetermined combination is entered; and
- combination lock means for operating said linkage in a second one of said modes to move said bolts to said door unlocked position independently of said electronic lock.

5. A security door locking system, comprising:
- one or more door locking bolts;
- bolt operating articulated linkage actuated by a manually operated means for moving said one or more bolts between door locking and unlocking positions in a first mode of operation;
- an electronic lock including means for preventing normal operation of said articulated linkage by said handle to unlock said door other than when a predetermined combination has been entered in said electronic lock; and
- a manually operated combination lock having a bolt member connected to said articulated linkage such that manual operation of said combination lock and its bolt member operates said linkage in an alternative manner to unlock said door while said electronic lock continues to prevent normal operation of said linkage.

6. A manually operated bypass mechanism for a safe locking mechanism including an electronic digital safe lock wherein said electronic lock includes a slide plate and means for operating it by manipulation of a lock dial after digital input of an electronic lock combination and a plurality of safe door locking bolts operable between locking and unlocking positions by a bolt camming member, said mechanism comprising the provision of:
- a pivotally operating linkage means connected between said slide plate and said bolt camming member for pivotally operating said bolt camming member to move said bolts between said positions upon manipulation of said lock dial;
- a manually operable combination lock including a movable slide bolt; and
- means for pivotally connecting said slide bolt to said pivotally operating linkage means to operate said linkage to move said camming member to a safe bolt unlocking position independent of movement of said slide plate.

7. A manually operated bypass mechanism pg,16 according to claim 6 wherein said pivotally operating linkage comprises:
- a lever having means for pivotally connecting a first end to said bolt camming member;
- a first pivotal connection near a mid-portion of said lever for pivotally connecting said slide plate to said lever mid-portion; and
- a second pivotal connection near a second end of said lever for pivotally connecting said slide bolt to said lever second end; whereby
- on operation of said electronic lock and lock dial, said second pivotal connection means functions as a stationary pivot for pivotal movement of said control lever imparted by movement of said slide plate and on operation of said combination lock, said first pivotal connecting means functions as a stationary pivot for pivotal movement of said control lever imparted by movement of said slide bolt.

* * * * *